US007672612B2

(12) United States Patent
Ishii

(10) Patent No.: US 7,672,612 B2
(45) Date of Patent: Mar. 2, 2010

(54) ELECTROPHOTOGRAPHIC PHOTOSENSITIVE MEMBER, AND IMAGE FORMING APPARATUS USING SAME

(75) Inventor: Yoshinobu Ishii, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 607 days.

(21) Appl. No.: 11/626,266

(22) Filed: Jan. 23, 2007

(65) Prior Publication Data

US 2007/0177897 A1 Aug. 2, 2007

(30) Foreign Application Priority Data

Jan. 27, 2006 (JP) ..... 2006-019720

(51) Int. Cl.
*G03G 15/00* (2006.01)

(52) U.S. Cl. ..... 399/159; 399/116

(58) Field of Classification Search ..... 399/116, 399/159

See application file for complete search history.

(56) References Cited

U.S. PATENT DOCUMENTS 4,931,841 A * 6/1990 Yoshihara ..... 399/347

FOREIGN PATENT DOCUMENTS

| | | |
|---|---|---|
| JP | 08-171222 | 2/1996 |
| JP | 08-272190 | 10/1996 |
| JP | 11-265098 | 9/1999 |
| JP | 2003-195576 | 9/2003 |
| JP | 2003-295528 | 10/2003 |

* cited by examiner

*Primary Examiner*—David M Gray
*Assistant Examiner*—Ryan D Walsh
(74) *Attorney, Agent, or Firm*—Hogan & Hartson LLP

(57) ABSTRACT

The present invention relates to an electrophotographic photosensitive member including a substantially cylindrical body rotated by rotation power transmitted via an first end portion from in an image forming apparatus and a photosensitive layer including a latent image forming area formed on an outer circumference of the body. The present invention also relates to an image forming apparatus provided with the electrophotographic photosensitive member. In the photosensitive layer, when the body is charged with a constant charging ability in the axial direction, dark electric potential at the latent image forming area gradually becomes larger as proceeding in the axial direction of the body, from the first end portion to a second end portion opposite to the first end portion.

18 Claims, 12 Drawing Sheets

ELECTROPHOTOGRAPHIC PHOTOSENSITIVE MEMBER, AND IMAGE FORMING APPARATUS USING SAME

CROSS-REFERENCE TO RELATED APPLICATIONS

The present application claims priority under 35 U.S.C. §119 to Japanese Patent Application No.2006-019720, filed Jan. 27, 2006 entitled "ELECTROPHOTOGRAPHIC PHOTOSENSITIVE MEMBER, AND IMAGE FORMING APPARATUS USING SAME." The contents of this application are incorporated herein by reference in their entirety.

TECHNICAL FIELD

The present invention relates to an electrophotographic photosensitive member and an image forming apparatus provided with the same.

BACKGROUND ART

An image forming apparatus such as a copying machine and a printer utilizing electrophotographic method is provided with an electrophotographic photosensitive member. In such image forming apparatus, the electrophotographic photosensitive member is rotated by a power transmitter, and synchronously with the rotation, operations such as electrification, exposure, development, transfer, and cleaning are repeated, thereby forming an image on a recording medium.

Specifically, in the image forming apparatus, the electrophotographic photosensitive member is electrically charged at its surface and then rotated while being irradiated by laser light for exposure, according to an image pattern, so that an electrostatic latent image is formed on the surface of the electrophotographic photosensitive member. Next, the latent image is developed by attaching toner to the photosensitive member. The toner attached to the electrophotographic photosensitive member is transferred to a recording medium. After the transfer of toner to the recording medium, the electrophotographic photosensitive member is rotated while a cleaning blade is pressed onto the surface of electrophotographic photosensitive member, so that remaining toner is removed.

The electrophotographic photosensitive member includes a metal cylindrical body formed with a photosensitive layer. The photosensitive layer includes a photoconductive layer formed on the cylindrical body using inorganic material, and a surface layer formed using inorganic material to coat the photoconductive layer. In the photoconductive layer and the surface layer, when charging the photosensitive layer with a constant charging ability in the axial direction, dark electric potential in the axial direction of the latent image forming area of the photosensitive layer is substantially the same at any portion part of an first end portion, an intermediate portion, and a second end portion of the body (i.e. absolute value of slope of a primary approximate line, obtained by measuring the dark electric potential in the axial direction and then primarily approximate the measurement value in the axial direction, is not more than 0.3V/cm).

As shown in FIG. 12, an electrophotographic photosensitive member 8 includes an end 80 to which rotation energy is applied by a power transmitter 81, and an end 82 rotatably supported by a bearing flange 83.

The power transmitter 81 includes a power transmitting flange 84 fixed to the electrophotographic photosensitive member 8 and a gear 85 engaging with the power transmitting flange 84. The power transmitting flange 84 is firmly fixed to an inside low portion 86 of the electrophotographic photosensitive member 8 for rotating the electrophotographic photosensitive member 8. On the other hand, the bearing flange 83 allows the rotation of the electrophotographic photosensitive member 8, and not to prevent the rotation, is arranged to have a play (gap) 88 relative to an inside low portion 87 of the electrophotographic photosensitive member 8.

As described above, the power transmitting flange 84 is firmly fixed to the inside low portion 86 of the electrophotographic photosensitive member 8, while the bearing flange 83 is attached to the inside low portion 87 of the electrophotographic photosensitive member 8 with the gap 88. With such arrangement, when charging a photosensitive layer 89 by an electrification mechanism 9 while rotating the electrophotographic photosensitive member 8, the electrophotographic photosensitive member 8 and the electrification mechanism 9 can not be kept parallel to each other, so that distance therebetween tends to be smaller at the power transmitting flange 84 than at the bearing flange 83.

When using a non-contact electrification mechanism, dark electric potential at the electrophotographic photosensitive member 8 depends on the distance between the electrophotographic photosensitive member 8 and the electrification mechanism 9. On the other hand, when using a contact electrification mechanism (not shown), dark electric potential at the electrophotographic photosensitive member 8 depends on a nip width which is a circumferential dimension of a contact area between the electrophotographic photosensitive member 8 and the electrification mechanism 9. The nip width depends on the distance between the axes of the electrophotographic photosensitive member 8 and the electrification mechanism 9. Therefore, when the distance between the electrophotographic photosensitive member 8 and the electrification mechanism 9 tends to be smaller at the power transmitting flange 84 than at the bearing flange 83, regardless of whether the electrification mechanism 9 is non-contact or contact type, the dark electric potential tends to be higher at the power transmitting flange 84 than at the bearing flange 83.

Such bias in dark electric potential in the axial direction causes bias in electrostatic adhesion of toner, which results in variation in density of an image formed on a recording medium.

Patent Document 1: JP-A-11-265098

Patent Document 2: JP-A-8-272190

DISCLOSURE OF THE INVENTION

An object of the present invention is to provide an electrophotographic photosensitive member and an image forming apparatus provided with the photosensitive member, for preventing bias in electrostatic adhesion of toner due to bias in dark electric potential at the electrophotographic photosensitive member, thereby preventing defective images.

An electrophotographic photosensitive member according to the present invention comprises a substantially cylindrical body rotated by rotation power transmitted via its a first end portion from in an image forming apparatus and a photosensitive layer including a latent image forming area formed on an outer circumference of the body.

An image forming apparatus according to the present invention comprises an electrophotographic photosensitive member, a power transmitter for transmitting rotation power to a first end portion of the electrophotographic photosensitive member in the axial direction and an electrification mechanism for charging with a constant charging ability in the axial direction.

The electrophotographic photosensitive member comprises a substantially cylindrical body and a photosensitive layer including a latent image forming area formed on an outer circumference of the body.

In the photosensitive layer, when the body is charged with a constant charging ability in the axial direction, dark electric potential at the latent image forming area gradually becomes higher as proceeding in the axial direction of the body, from the first end portion to a second end portion opposite to the first end portion.

BEST MODE FOR CARRYING OUT THE INVENTION

An image forming apparatus and an electrophotographic photosensitive member according to the present invention are specifically described below with reference to the accompanying drawings.

Figure 1:
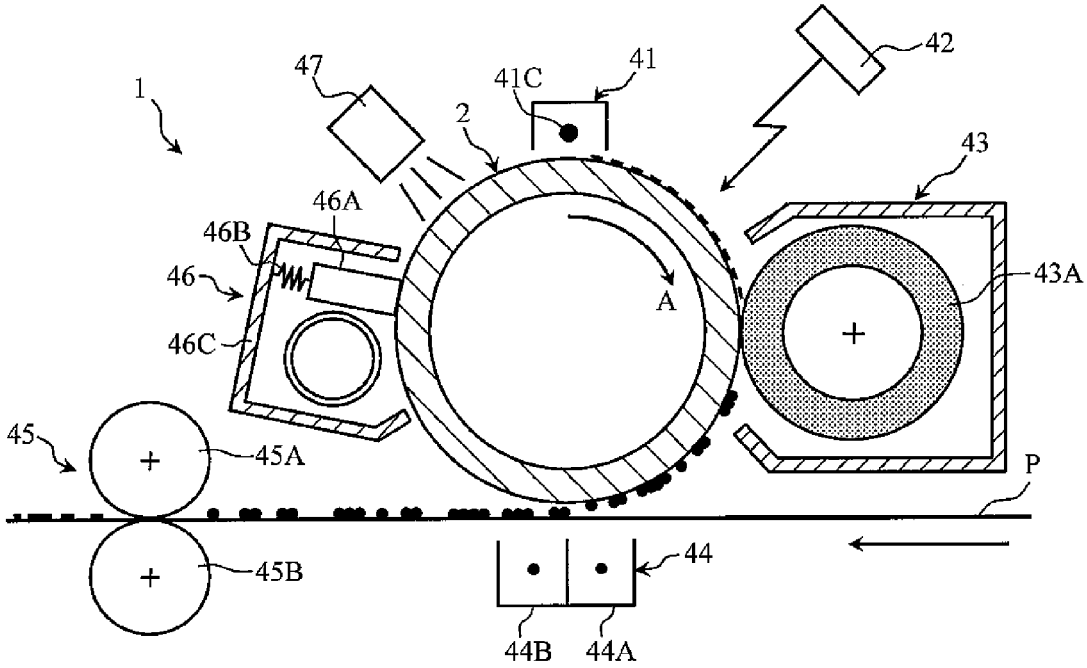
FIG. 1 is a schematic view illustrating an example of an image forming apparatus according to the present invention.
Figure 2:
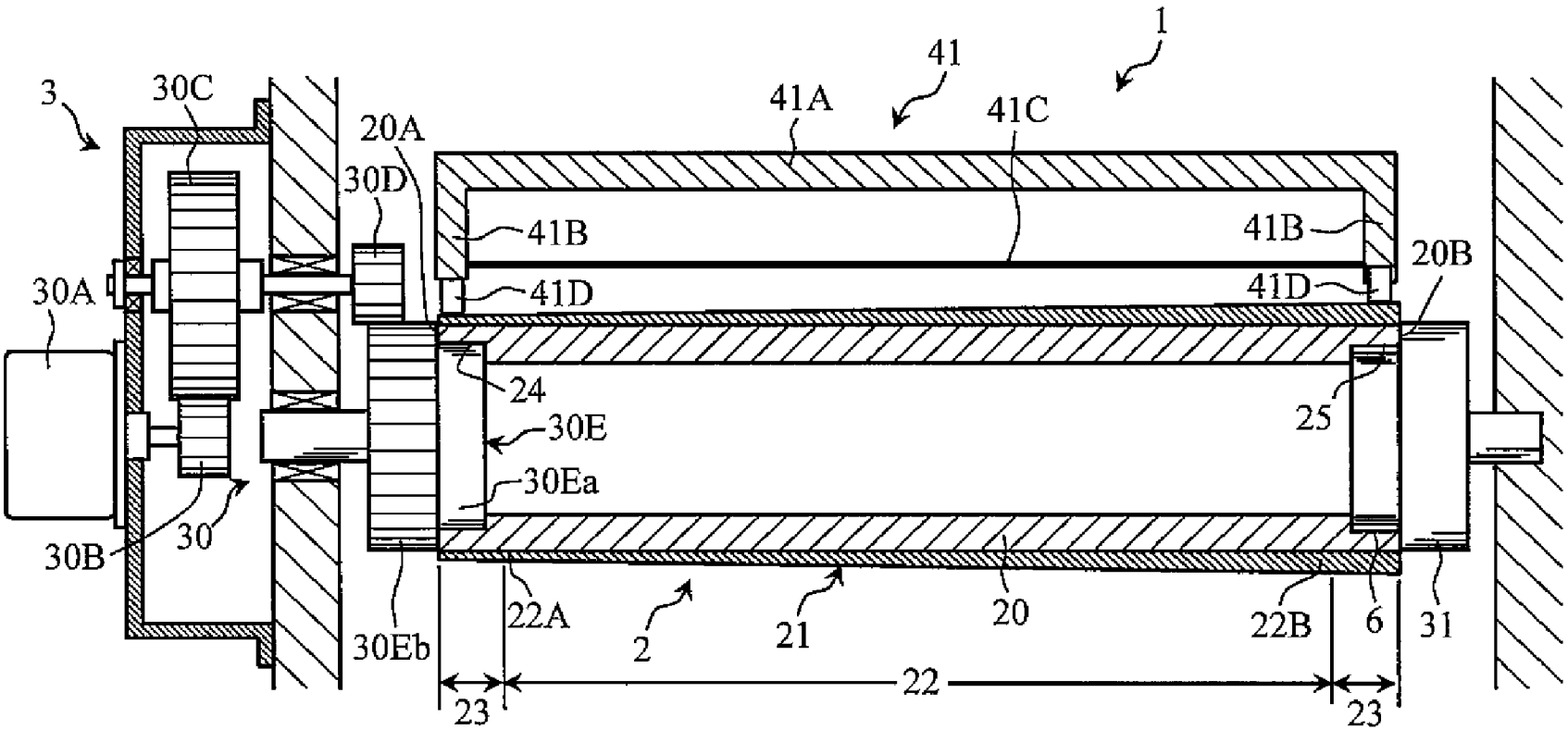
FIG. 2 is a sectional view of the principal portions of the image forming apparatus, illustrating relationship between an electrophotographic photosensitive member and an electrification mechanism.

An image forming apparatus 1 shown in FIGS. 1 and 2 utilizes the Carlson method for image forming, and includes an electrophotographic photosensitive member 2, a rotation mechanism 3, an electrification mechanism 41, an exposure mechanism 42, a development mechanism 43, a transfer mechanism 44, a fixing mechanism 45, a cleaning mechanism 46, and a discharging mechanism 47.

Figure 3:
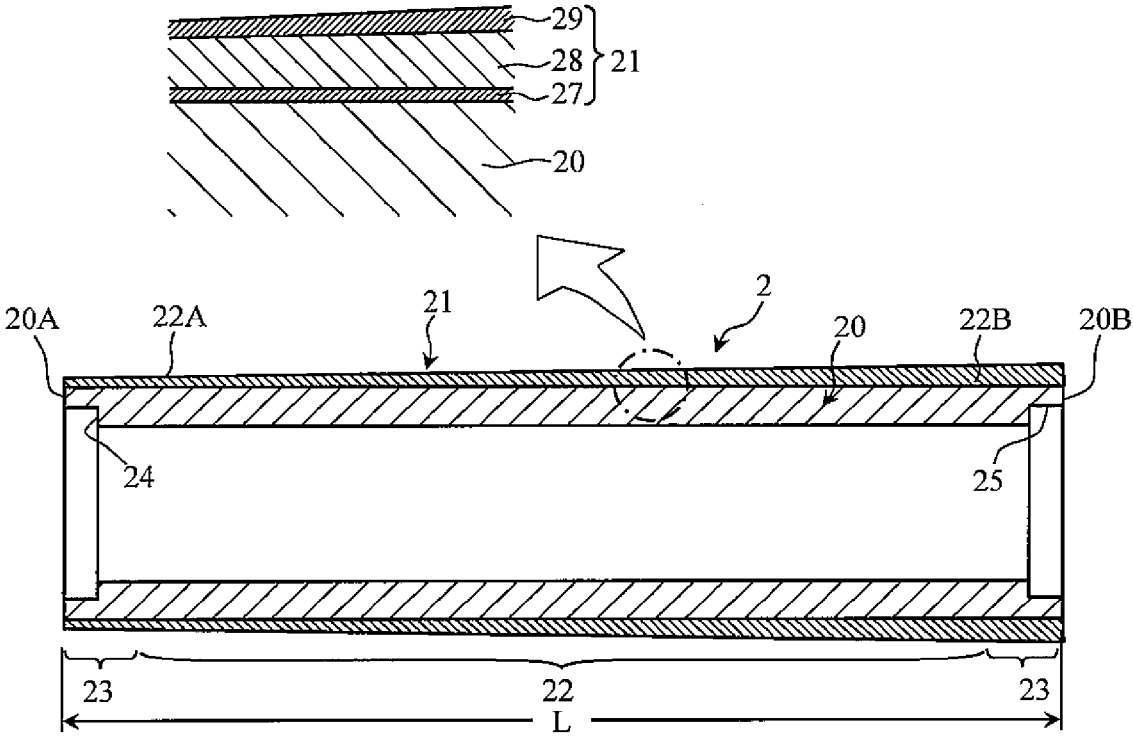
FIG. 3 is a sectional view and an enlarged view thereof illustrating an example of the electrophotographic photosensitive member according to the present invention.

As shown in FIG. 2, an electrophotographic photosensitive member 2 forms an electrostatic latent image or a toner image according to an image signal, and can be rotated in the direction of an arrow A in FIG. 1, by a rotation mechanism 3. As shown in FIG. 3, the electrophotographic photosensitive member 2 includes a cylindrical body 20 having a surface formed with a photosensitive layer 21.

The cylindrical body 20 forms the skeleton of the electrophotographic photosensitive member 2 and holds the electrostatic latent image on its outer circumference. The axis of the cylindrical body 20 has a length L slightly longer than the maximum length of a recording medium P such as a recording paper to be used. Specifically, the length L of the axis is set so that the cylindrical body 20 extends beyond the ends of the recording medium P by not less than 0.5 cm and not more than 5 cm. Thus, the photosensitive layer 21 includes a latent image forming area 22 corresponding to the maximum length of the recording medium P, and non-latent image forming areas 23 provided at the ends of the cylindrical body, next to the latent image forming area 22. The non-latent image forming areas 23 are areas of the photosensitive layer 21 (at the outside of the latent image forming area 22 in the axial direction) which are never to be used in forming a latent image of any size on the photosensitive layer 21.

The cylindrical body 20 is provided with inside low portions 24, 25 having relatively large inner diameter. The inside low portion 24 is a portion to which a power transmitting flange 30E, which is to be described later, of the rotation mechanism 3 is fitted, while the inside low portion 25 is a portion to which a bearing flange 31, which is to be described later, of the rotation mechanism 3 is fitted. The illustrated inside low portions 24, 25 are arranged within areas corresponding to the non-latent image forming areas 23, though may extend to an area corresponding to the latent image forming area 22.

Such cylindrical body 20 is conductive at least on its surface. Specifically, the cylindrical body 20 may be made of a conductive material as a whole, or may be made of an insulating material having a conductive film formed thereon. The conductive material for forming the cylindrical body 20 may include metal such as Al or SUS (stainless), Zn, Cu, Fe, Ti, Ni, Cr, Ta, Sn, Au, and Ag, and an alloy of these metals, for example. The insulating material for forming the cylindrical body 20 may include resin, glass, and ceramic. The material for forming the conductive film may include a transparent conductive material such as ITO (Indium Tin Oxide) and $SnO_2$, other than the above-described metals. The transparent conductive material can be deposited on the surface of the insulating cylindrical body, utilizing a conventional method such as vapor deposition. Preferably, the cylindrical body 20 is formed of Al alloy material as a whole. In this way, the electrophotographic photosensitive member 2 having a light weight can be made at a low cost, and further, the adhesion between the cylindrical body and an anti-charge injection layer 27 and a photoconductive layer 28, both to be described below, of the photosensitive layer 21 is reliably enhanced when forming the layers 27, 28 by amorphous silicon (a-Si) material.

The photosensitive layer 21 includes is formed by lamination of an anti-charge injection layer 27, in addition to the photoconductive layer 28 and the surface layer 29 laminated together. In the latent image forming area 22 of the photosensitive layer 21, the thickness at the first end portion 22A at the side of the power transmitting flange 30E, which is to be described later, of the rotation mechanism 3 is smaller than the thickness at the second end portion 22B at the side of the bearing flange 31, which is to be described later, of the rotation mechanism 3. Further, in the photosensitive layer 21, when charging the cylindrical body 20 in the axial direction with a constant charging ability, dark electric potential at the latent image forming area 22 gradually becomes higher as proceeding from the first end portion 22A to the second end portion 22B. Specifically, in the photosensitive layer 21, slope of a primary approximate line, indicating relationship between a distance from an end 20A of the cylindrical body 20 at the side of the first end portion 22A in the axial direction and a measurement value of dark electric potential in the axial direction when charging the photosensitive layer 21 at a voltage selected from not less than 300V and not more than 600V, is not less than 0.4V/cm and not more than 1.5V/cm, for example. The absolute value of difference between the value indicated by the primary approximate line and the measurement value of dark electric potential is preferably not more than 10V.

Here, the constant charging ability in the present invention indicates an ability to charge two electrophotographic photosensitive members 2 having the same photosensitive layers 21 under the same charging conditions (e.g. distance to the electrification mechanism 41 and charging voltage) so that the dark electric potential at each of the photosensitive layers 21 is the same (or the difference in the dark electric potential of each of the layers is not more than 3V).

The dark electric potential at the photosensitive layer 21 of the electrophotographic photosensitive member 2 may be a value obtained by measuring, in a dark condition (light-shielded condition), the surface of the photosensitive layer 21 charged by the electrification mechanism 41 using a non-contact surface potential measuring devicevoltmeter ("MODEL 344" manufactured by TREK, Inc.).

The primary approximate line may be calculated by least-square method to indicate the relationship between the value obtained by measuring the dark electric potential in the axial direction of the cylindrical body and the distance from the end 20A of the cylindrical body 20 at the side of the first end portion 22A.

The anti-charge injection layer 27 serves to prevent injection of electrons and electron holes from the cylindrical body 20 into the photoconductive layer 28, and various types of anti-charge injection layer 27 may be used depending on the material of the photoconductive layer 28. The anti-charge injection layer 27 may be made of an inorganic material, for example, and if using a-Si material for the photoconductive layer 28, the anti-charge injection layer 27 may also be made of an inorganic material such as a-Si material. In this way, electrophotographic photosensitive property with enhanced adhesiveness between the cylindrical body 20 and the photoconductive layer 28 can be obtained.

In forming the anti-charge injection layer 27 using a-Si material, the material may contain a thirteenth group element of the periodic system (hereinafter referred to as "thirteenth group element") or a fifteenth group element of the periodic system (hereinafter referred to as "fifteenth group element") in an amount larger than those contained in the photoconductive layer 28 of a-Si material so as to determine the conductivity type. Further, a large amount of boron (B), nitrogen (N), or oxygen (O) may be also contained so as to have high resistivity.

Note that the anti-charge injection layer 27 is optional and is not always necessary. The anti-charge injection layer 27 may be replaced with a long-wavelength light absorbing layer. The long-wavelength light absorbing layer prevents a long-wavelength light (light of a wavelength of not less than 0.8 μm) entering on exposure from reflecting on the surface of the cylindrical body 20, and thus prevents a fringe pattern generated at a formed image.

In the photoconductive layer 28, electrons are excited by a laser irradiation from the exposure mechanism 42, and a carrier of free electrons or electron holes is generated. The thickness of the photoconductive layer 28 may be determined according to a photoconductive material and a desired electrophotographic property, at least the thickness at the second end portion 22B at the side of the bearing flange 31 in the latent image forming area 22 is larger than the thickness at the first end portion 22A at the side of the power transmitting flange 30E in the latent image forming area 22. The thickness of the photoconductive layer 28 gradually becomes larger as proceeding from the first end portion 22A toward the second end portion 22B. The thickness of the photoconductive layer 28 may also become larger stepwise from the first end portion 22A toward the second end portion 22B.

In the photoconductive layer 28, the ratio of the thickness at the first end portion 22A to the thickness at the second end portion 22B of is not less than 1.03 to 1 and not more than 1.25 to 1. In forming the photoconductive layer 28 using a-Si material, the thickness at the first end portion 22A is set to not less than 5 μm and not more than 100 μm, preferably not less than 15 μm and not more than 80 μm, while the thickness at the second end portion 22B is set to not less than 5.15 μm and not more than 125 μm, preferably not less than 15.45 μm and not more than 100 μm. In the photoconductive layer 3, the difference between the thickness at the second end portion 22B and at the first end portion 22A is set to not less than 1.0 μm and not more than 9.0 μm, preferably not less than 1.0 μm and not more than 6.0 μm.

By gradually increasing the thickness of the photoconductive layer 28 as proceeding from the first end portion 22A to the second end portion 22B, when the electrophotographic photosensitive member 2 is incorporated in the image forming apparatus 1, even if the distance between the photosensitive layer 21 and the electrification mechanism 41 becomes smaller at the first end portion 22A than at the second end portion 22B due to the play at the side of the bearing flange 31, the difference in distance may be reduced.

Here, when the axial length of the cylindrical body 20 is L, the first end portion 22A in the latent image forming area 22 is a portion of the photosensitive layer 21 spaced from an end 20A of the cylindrical body 20 of the photosensitive layer 21 by not less than 0.1 L and not more than 0.25 L in the axial direction of the cylindrical body 20, while the second end portion 22B in the latent image forming area 22 is a portion of the photosensitive layer 21 spaced from another end 20B of the cylindrical body 20 of the photosensitive layer 21 by not less than 0.75 L and not more than 0.9 L in the axial direction of the cylindrical body 20.

Here, the thickness of the photoconductive layer 28 at each of the first and second end portions 22A, 22B in the latent image forming area 22 is an average value of thickness measured at any five points along the circumference of each of the end portions 22A, 22B. However, in measuring the thickness, particular portions with defective film or broken film are not measured. The thickness of the photoconductive layer 28 is calculated by optical interferometry. Specifically, light at not less than 1000 nm and not more than 1100 nm is entered into the target portions to obtain a light transmission curve, so that the thickness is calculated based on the maximum and minimum of the transmission curve and on the refractive index at the surface layer (reference document: page 42-46 of "Measurement and Evaluation of Thin Layer Material" issued by TECHNICAL INFORMATION INSTITUTE CO., LTD)

Further, in the photoconductive layer 28, when charging the cylindrical body 20 in the axial direction with a constant charging ability, dark electric potential at the latent image forming area 22 gradually becomes higher as proceeding from the first end portion 22A to the second end portion 22B. Specifically, in the photoconductive layer 28, slope of a primary approximate line, indicating relationship between a distance from the end 20A of the cylindrical body 20 at the side of the first end portion 22A in the axial direction and a measurement value of dark electric potential in the axial direction when charging the photosensitive layer 21 at a voltage selected from not less than 300V and not more than 600V, is not less than 0.4V/cm and not more than 1.5V/cm, for example. The absolute value of difference between the value indicated by the primary approximate line and the measurement value of dark electric potential is preferably not more than 10V.

The dark electric potential at the photoconductive layer 28 of the electrophotographic photosensitive member 2 may be a value obtained by measuring, in a dark condition (light-shielded condition), the surface of the photoconductive layer 28 charged by the electrification mechanism 41 using the non-contact surface potential measuring device voltmeter ("MODEL 344" manufactured by TREK, Inc.).

The primary approximate line may be calculated by least-square method to indicate the relationship between the value obtained by measuring the dark electric potential in the axial direction of the cylindrical body and the distance from the end 20A of the cylindrical body 20 at the side of the first end portion 22A.

The photoconductive layer 28 is formed of a-Si material, amorphous selenium material such as a-Se, Se—Te, and As2Se3, or chemical compound of twelfth group element and sixteenth group element of the periodic system such as ZnO, CdS, and CdSe, for example. As the a-Si material, a-Si, a-SiC, a-SiN, a-SiO, a-SiGe, a-SiCN, a-SiNO, a-SiCO or a-SiCNO may be used. Especially when the photoconductive layer 28 is made of a-Si, or an a-Si alloy material of a-Si and an element such as C, N, and O, it is able to have high luminous sensitivity, high-speed responsiveness, stable repeatability, high heat resistance, high endurance, and so on, thereby reliably obtaining enhanced electrophotographic property. Further, in addition to the above condition, by forming the surface layer 29 using a-SiC:H, conformity of the photoconductive layer with the surface layer 29 is enhanced. The photoconductive layer 28 may be also formed by changing the above-described inorganic material into particles, and by dispersing the particles in a resin, or may be formed as an OPC photoconductive layer.

In forming the photoconductive layer 28 using an inorganic material as a whole, it can be formed by conventional film formation methods such as glow discharge decomposition method, various sputtering methods, various vapor deposition methods, ECR method, photo-induced CVD method, catalyst CVD method, and reactive vapor deposition method, for example. In film forming of the photoconductive layer 28, hydrogen (H) or a halogen element (F, Cl) may be contained in the film by not less than one atom % and not more than 40 atom % for dangling-bond termination. Further, in forming the photoconductive layer 28, for obtaining a desired property such as electrical property including e.g. dark conductivity and photoconductivity as well as optical bandgap in respective layers, thirteenth group element or fifteenth group element, or an adjusted amount of element such as C, N, and O may be contained.

As the thirteenth group element and the fifteenth group element, in view of high covalence and sensitive change of semiconductor property, as well as of high luminous sensitivity, it is desired to use boron (B) and phosphorus (P). When the thirteenth group element and the fifteenth group element are contained in combination with elements such as C, N, and O, preferably, the thirteenth group element may be contained by not less than 0.1 ppm and not more than 20000 ppm, while the fifteenth group element may be contained by not less than 0.1 ppm and not more than 10000 ppm.

When the photoconductive layer 28 contains none or only a small amount (not less than 0.01 ppm and not more than 100 ppm) of the elements such as C, N, and O, preferably, the thirteenth group element may be contained by not less than 0.1 ppm and not more than 200 ppm, while the fifteenth group element may be contained by not less than 0.01 ppm and not more than 100 ppm. These elements may be contained in a manner that concentration gradient is generated in the thickness direction of the layers, if the average content of the elements in the layers is within the above-described range.

In forming the photoconductive layer 28 using a-Si material, μc-Si (microcrystal silicon) may be contained, which enhances dark conductivity and photoconductivity, and thus advantageously increases design freedom of the photoconductive layer 3. Such μc-Si can be formed by utilizing a method similar to the above-described method, and by changing the film forming condition. For example, when utilizing glow discharge decomposition method, the layer can be formed by setting temperature and high-frequency electricity at the cylindrical body 20 higher than in the case using only a-Si, and by increasing flow amount of hydrogen as diluent gas. Further, impurity elements similar to the above-described elements may be added when μc-Si is contained.

Figure 4:
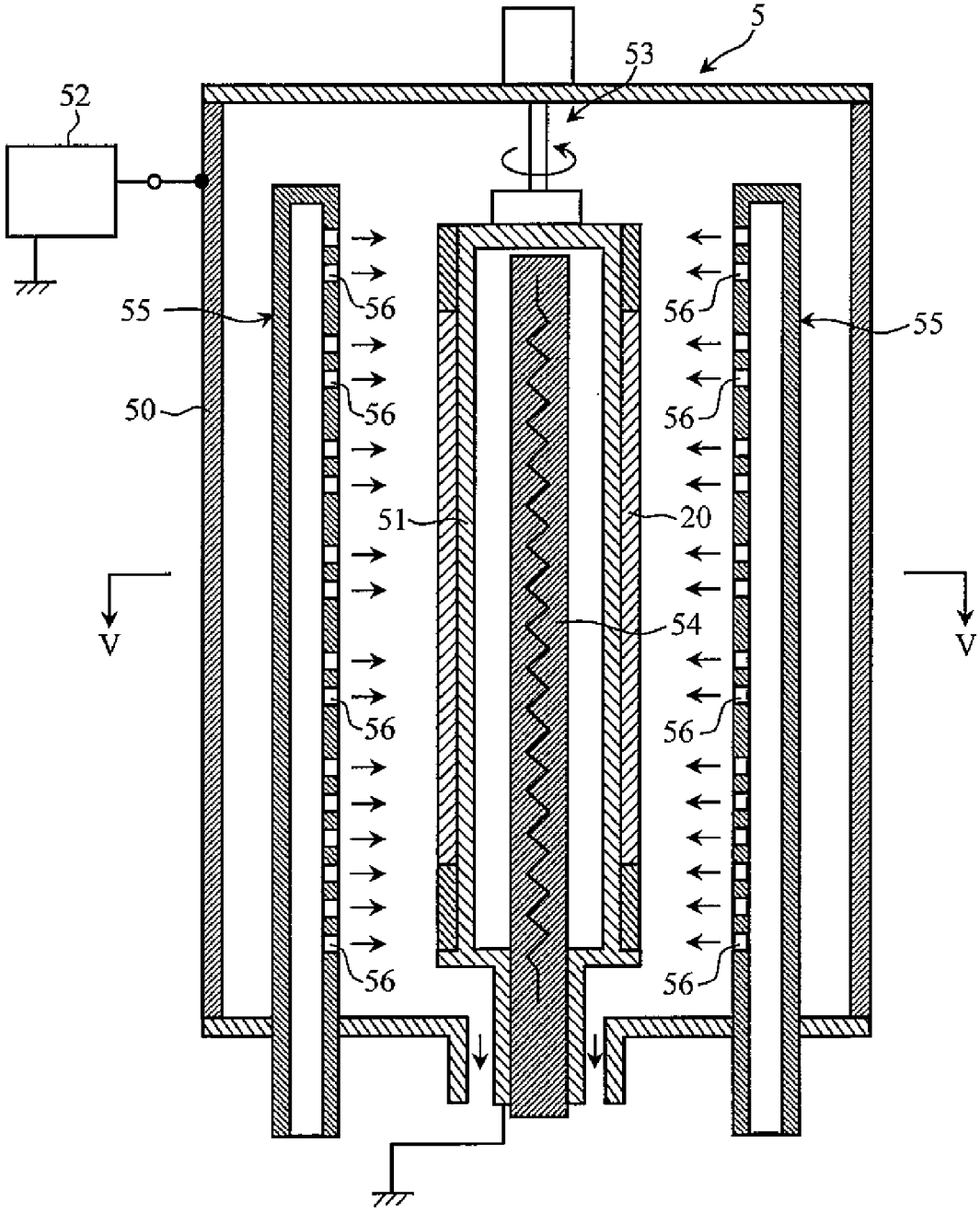
FIG. 4 is a sectional view illustrating an example of a glow discharge decomposition device for manufacturing the electrophotographic photosensitive member of FIG. 3.
Figure 5:
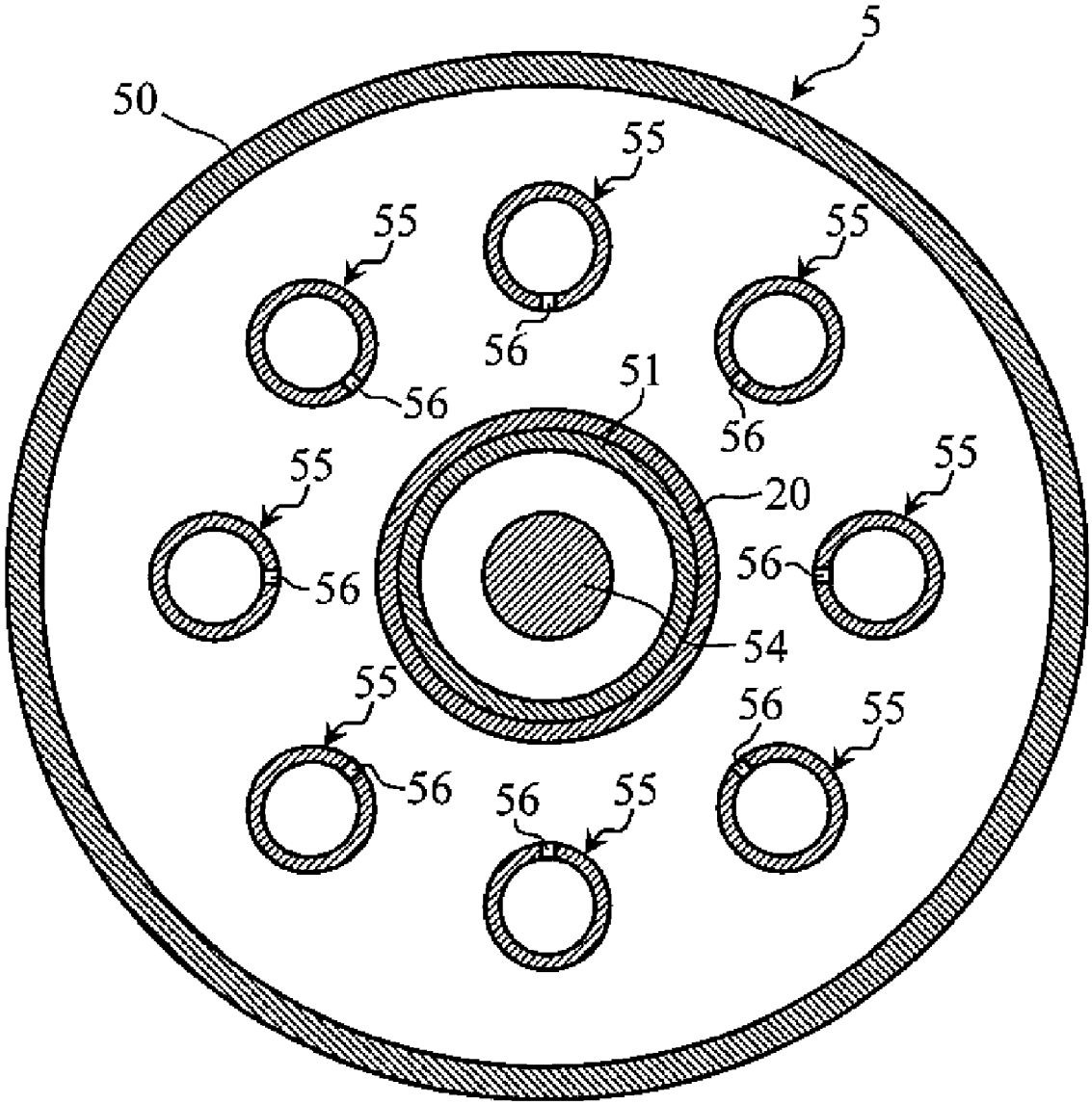
FIG. 5 is a sectional view taken along lines V-V of FIG. 4.

Such photoconductive layer 28 can be formed by a glow discharge decomposition device 5 shown in FIGS. 4 and 5, for example. The illustrated glow discharge decomposition device 5 includes a cylindrical vacuum container 50 having an intermediate portion provided with a supporting member 51 for supporting the cylindrical body 20. By glow discharge plasma, a-Si film is formed on the cylindrical body 20. In the glow discharge decomposition device 5, the supporting member 51 is grounded and the vacuum container 50 is connected to a high-frequency power source 52 for applying high-frequency power between the vacuum container 50 and the supporting member 51 (cylindrical body 20). The supporting member 51 can be rotated by a rotating mechanism 53, and heated by a heater 54 provided therein. The glow discharge decomposition device 5 further includes a plurality (eight in the figure) of gas inlet tubes 55 surrounding the supporting member 51 (cylindrical body 20). Each of the gas inlet tubes 55 is provided with a plurality of gas inlet ports 56 aligned in the axial direction. The gas inlet ports 56 of the gas inlet tube 55 are positioned to face the cylindrical body 20, so that material gas introduced through the gas inlet ports 56 is blew out toward the cylindrical body 20.

In forming a-Si film on the cylindrical body 20 using the glow discharge decomposition device 5, material gas of predetermined amount and gas ratio is introduced into the cylindrical body 20 through the gas inlet ports 56 of the gas inlet tubes 55. Here, the cylindrical body 20 together with the supporting member 51 is rotated by the rotating mechanism 53. The high-frequency power source 52 applies high-frequency power between the vacuum container 50 and the supporting member 51 (cylindrical body 20), and glow discharge is performed to decompose the material gas, so that a-Si film is formed on the cylindrical body 20 which is set at a desired temperature.

Figure 6:
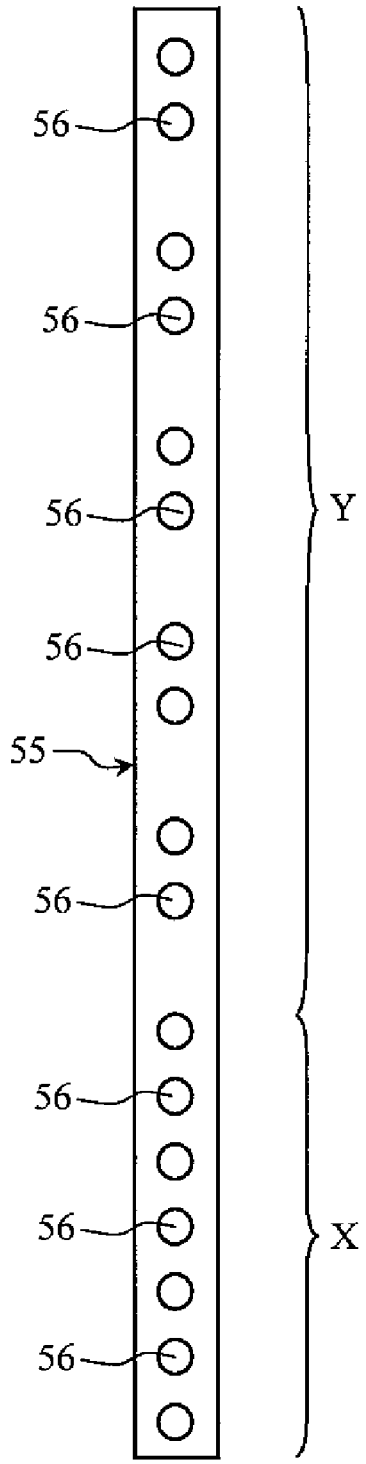
FIG. 6 is a front view illustrating an example of a gas inlet tube of the glow discharge decomposition device shown in FIGS. 4 and 5.

In using such glow discharge decomposition device 5, by arranging the gas inlet ports 56 of each of the gas inlet tubes 55 at intervals changing gradually or stepwise, the thickness and charging characteristic of the photoconductive layer 28 may be changed gradually or stepwise in the axial direction. For example, as shown in FIG. 6, in an area Y corresponding to the area of the photoconductive layer 28 including the first end portion 22A, the gas inlet tubes 56 are arranged at intervals longer than those in an area X corresponding to the area including the second end portion 22B. In this way, the thickness can be larger at the second end portion 22B than at the first end portion 22A. Further, when using the gas inlet tube 55 shown in FIG. 6, by adding boron (B) in the material gas, the charging characteristic (the dark electric potential when charged) at the second end portion 22B of the photoconductive layer 28 may be higher than at the first end portion 22A of the photoconductive layer 28.

Figure 7:
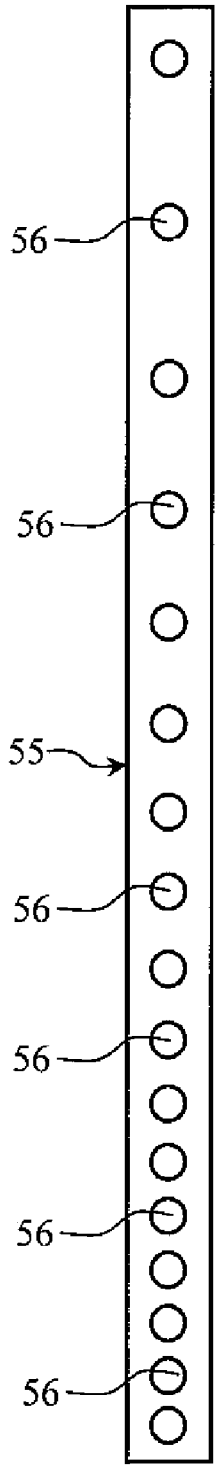
FIG. 7 is a front view illustrating another example of the gas inlet tube of the glow discharge decomposition device shown in FIGS. 4 and 5.

The ratio of intervals in the area X to intervals in the area Y may be set according to the thickness of the photoconductive layer 28 at the first and second end portions 22A, 22B, to the ratio of thickness of the photoconductive layer 28 at the end portion 22A to the one at the end portion 22B, or to the desired charging characteristic, and may be set to not less than 1.06 to 1 and not more than 2.25 to 1, for example. The gas inlet tube 55 for forming the photoconductive layer 28 may be provided, as shown in FIG. 7, with a plurality of gas inlet ports 56 arranged at shorter intervals as proceeding toward an end.

In FIG. 6, the gas inlet ports 56 of the gas inlet tubes 55 are arranged at shorter intervals in the bottom area but not limited to this, and may be arranged at short intervals in the top area, for example.

Further, by providing temperature distribution in the axial direction of the cylindrical body 20 using the heater 54, the thickness of the photoconductive layer 28 can be larger at the second end portion 22B than at the first end portion 22A. Specifically, by setting the temperature of the cylindrical body 20 higher in the area corresponding to the second end portion 22B than the temperature in the area corresponding to the first end portion 22A, the thickness at the second end portion 22B can be larger than at the first end portion 22A.

The surface layer 29 shown in FIG. 3 for protecting the photoconductive layer 28 from friction and wear is laminated on the surface of the photoconductive layer 28. The surface layer 29 is formed of an inorganic material represented by a-Si material such as a-SiC, and has a thickness of not less than 0.2 μm and not more than 1.5 μm. By making the surface layer 29 to have a thickness of not less than 0.2 μm, flaw in image and variation in density due to wear can be prevented, and by making the surface layer 26 to have a thickness of not more than 1.5 μm, initial characterization (such as defective image due to residual potential) can be improved. Preferably, the thickness of the surface layer 29 may be not less than 0.5 μm and not more than 1.0 μm.

In the surface layer 29, the thickness at the first end portion 22A at the side of the power transmitting flange 30E is smaller than the thickness at the second end portion 22B at the side of the bearing flange 31. The ratio of thickness of the surface layer 29 at the second end portion 22B to the one at the first end portion 22A may be set to not less than 1.03 to 1 and not more than 1.25 to 1. The difference between the thickness at the second end portion 22B and at the first end 22A portion is set to not less than 0.03 μm to not more than 0.21 μm, preferably not less than 0.09 μm and not more than 0.14 μm.

By gradually increasing the thickness of the surface layer 29 as proceeding from the first end portion 22A to the second end portion 223, when the electrophotographic photosensitive member 2 is incorporated in the image forming apparatus 1, even if the distance between the photosensitive layer 21 and the electrification mechanism 41 becomes smaller at the first end portion 22A than at the second end portion 22B due to the play at the side of the bearing flange 31, the difference in distance may be reduced.

The thickness of the surface layer 29 at the first and second end portions 22A, 22B is defined similarly to the thickness of the photoconductive layer 28, and is similarly calculated by optical interferometry. However, wavelength of light used for measuring the thickness of the surface layer 29 is at not less than 400 nm and not more than 700 nm.

Further, in the surface layer 29, when charging the cylindrical body 20 in the axial direction with a constant charging ability, the dark electric potential at the latent image forming area 22 gradually becomes higher as proceeding from the first end portion 22A to the second end portion 22B. Specifically, in the surface layer 29, slope of a primary approximate line, indicating relationship between a distance from the end 20A of the cylindrical body 20 at the side of the first end portion 22A in the axial direction and a measurement value of dark electric potential in the axial direction when charging the photosensitive layer 21 at a voltage selected from not less than 300V and not more than 600V, is not less than 0.4V/cm and not more than 1.5V/cm, for example. The absolute value of difference between the value indicated by the primary approximate line and the measurement value of dark electric potential is preferably not more than 10V.

The dark electric potential at the surface layer 29 of the electrophotographic photosensitive member 2 may be a value obtained by measuring, in a dark condition (light-shielded condition), the surface of the photoconductive layer 28 charged by the electrification mechanism 41 using the non-contact surface potential measuring devicevoltmeter ("MODEL 344" manufactured by TREK, Inc.).

The primary approximate line may be calculated by least-square method to indicate the relationship between the value obtained by measuring the dark electric potential in the axial direction of the cylindrical body and the distance from the end 20A of the cylindrical body 20 at the side of the first end portion 22A.

Such surface layer 29 is preferably formed of a-SiC:H in which a-SiC contains hydrogen. Proportion of elements in a-SiC:H can be expressed in a composition formula a-$Si_{1-x}C_X$:H, in which the value of X is not less than 0.55 and less than 0.93, for example. By setting the value X to not less than 0.55, a proper hardness for the surface layer 29 can be obtained, and endurance of the surface layer 29 and thus of the electrophotographic photosensitive member 2 can be reliably maintained. By setting the value X to less than 0.93, a proper hardness for the surface layer 29 can be also obtained. Preferably, the value X is set to not less than 0.6 and not more than 0.7. In forming the surface layer 29 using a-SiC:H, H content may be set to about not less than one atom % and not more than 70 atom %. When the H content is set within the above range, Si—H binding is lower than Si—C binding, electrical charge trap generated by light irradiation on the surface of the surface layer 26 can be controlled, thereby suitably preventing residual potential. According to the knowledge of the inventors, by setting the H content to not more than about 45 atom %, more favorable result can be obtained.

Such surface layer 29 of a-SiC:H can be formed, similarly to the formation of the photoconductive layer 28 using a-Si material, utilizing the glow discharge decomposition device 5 shown in FIGS. 4 and 5. In this case, to make the thickness of the surface layer 29 at the first end portion 22A to be larger than at the second end portion 22B, material gas may include Si-containing gas such as silane gas ($SiH_4$), C-containing gas such as methane gas ($CH_4$), and if necessary, diluent gas such as $H_2$ gas, and the gas inlet tubes 55 illustrated in FIGS. 6 and 7 may be used similarly to the formation of the photoconductive layer 28. Further, the thickness at the second end portion 22B of the surface layer 29 can also be made larger than at the first end portion 22A, by setting the temperature of the cylindrical body 20 to be higher at an area corresponding to the second end portion 22B than at an area corresponding to the first end portion 22A.

In using the gas inlet tubes 55 shown in FIGS. 6 and 7 to make the thickness at the second end portion 22B larger than the thickness at the first end portion 22A, conditions are set as follows, for example: The gas ratio of $CH_4$ and $SiH_4$ is not less than 10 to 1 and not more than 300 to 1; The dilution rate using $H_2$ gas is not less than 0% and not more than 50%; The gas pressure for film forming is about not less than 0.15 Torr and not more than 0.65 Torr; The high-frequency electricity is about not less than 100 W and not more than 350 W per one cylindrical body 20; The temperature of the cylindrical body 20 is not less than 200° and not more than 300°; The high-frequency electricity is applied under frequency of 13.56 MHz, or under frequency of 13.56 MHz with pulse-modulation at 1 kHz.

The rotation mechanism 3 of the image forming apparatus 1 shown in FIG. 2 serves to rotate the electrophotographic photosensitive member 2, and includes a rotation system 30 in addition to the bearing flange 31.

The rotation system 30 transmits the rotation energy of a motor 30A to the electrophotographic photosensitive member 2, for rotating the electrophotographic photosensitive member 2. The rotation system 30 includes drive gears 30B, 30C, 30D, in addition to the motor 30A and the power transmission flange 30E.

The drive gears 30B, 30C, 30D include various sizes of gears for transmitting the rotation energy of the motor 30A to the power transmission flange 30E. The rotation speed of the electrophotographic photosensitive member 2 rotated via the drive gears 30B, 30C, 30D is a constant speed of 320 mm/sec, for example, as a circumferential velocity at the surface.

The power transmission flange 30E serves to transmit the rotation energy from the drive gears 30B, 30C, SOD to the electrophotographic photosensitive member 2. The power transmission flange 30E includes a fitting portion 30Ea to be fitted into the inside low portion 24 of the cylindrical body 20, and a gear portion 30Eb to engage with the gear 30D. The fitting portion 30Ea has an outer dimension substantially equal to the inner dimension of the inside low portion 24, and is non-rotatably fixed to the cylindrical body 20.

The bearing flange 31 rotatably supports the electrophotographic photosensitive member 2. The bearing flange 31 is fitted into the inside low portion 25 of the cylindrical body 20 with a gap 6 (so-called "play").

The rotation system 30 is not limited to the one including the drive gears 30B, 30C, 30D, but if capable of providing a predetermined rotation energy to the electrophotographic photosensitive member 2, may have other structure, such as a structure providing the rotation energy by a rotation belt, a wire, or a chain.

The electrification mechanism 41 is of a non-contact type called scorotron. Such electrification mechanism 41 includes a base 41A provided with a wire holding portion 41B to which a wire 41C is attached in substantially parallel with the axial direction of the electrophotographic photosensitive member 2. Though only one wire 41C is provided in the illustrated example, a plurality of wires 41C may be provided. The distance between the electrification mechanism 41 and the electrophotographic photosensitive member 2 is kept by a wheel 41D. The wheel 41D is brought into contact with the non-latent image forming area 23 of the photosensitive layer 21 of the electrophotographic photosensitive layer 21.

The distance between the surface of the electrophotographic photosensitive member 2 (the photosensitive layer 21) and the electrification mechanism 41 (the wire 41C) is set to not less than 0.1 mm and not more than 1.0 mm for example, and becomes larger as proceeding from the first end portion 22A to the second end portion 22B. Specifically, slope of a primary approximate line, indicating relationship between a distance from the end 20A of the cylindrical body 20 at the side of the first end portion 22A in the axial direction and a measurement value of distance between the latent image are 22 of the photosensitive layer 21 and the electrification mechanism 41 (the wire), is not less than 10 μm/cm and not more than 100 μm/cm, for example. Preferably, the absolute value of difference between the value indicated by the primary approximate line and the measurement value of distance is preferably not less than 700 μm.

In such electrification mechanism 41, by applying a bias voltage to the wire 41C, the photosensitive layer 21 of the electrophotographic photosensitive member 2 can be charged with a constant charging ability in the axial direction. The bias voltage is selected from not less than 300V and not more than 600V. As described above, in the latent image forming area 22 of the photosensitive layer 21, the slope of a primary approximate line, indicating relationship between a distance from the end 20A in the axial direction and a measurement value of dark electric potential in the axial direction when charging the photosensitive layer 21, is not less than 0.4V/cm and not more than 1.5V/cm, for example The absolute value of difference between the value indicated by the primary approximate line and the measurement value of dark electric potential is not more than 10V.

Figure 8:
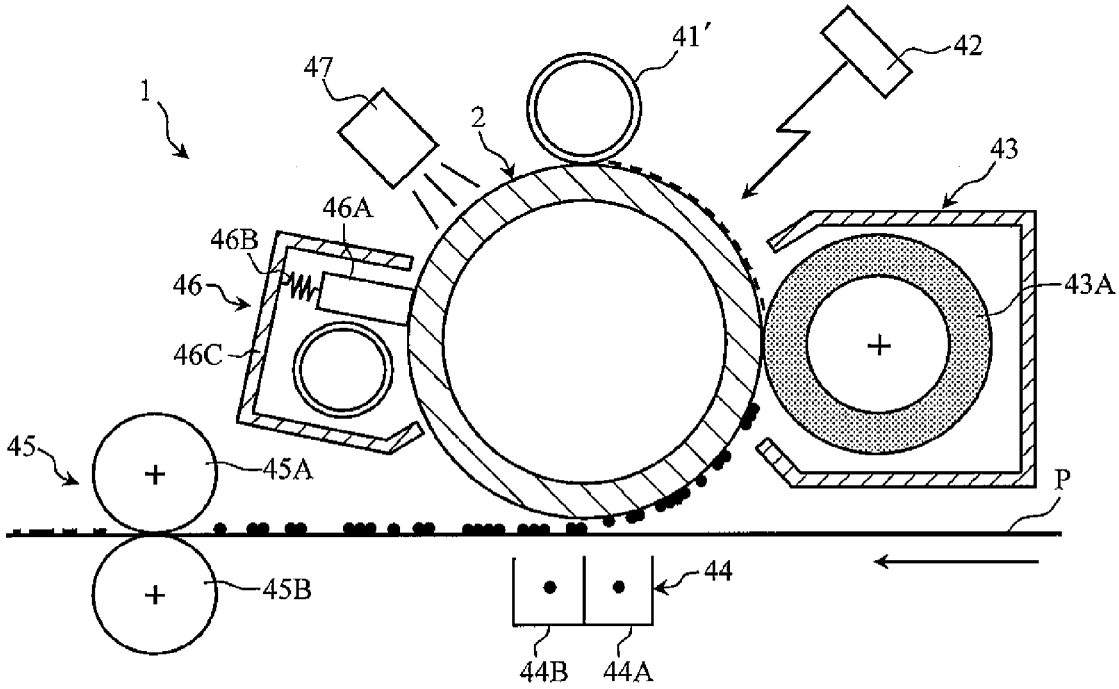
FIG. 8 is a schematic view illustrating another example of the image forming apparatus according to the present invention.
Figure 9:
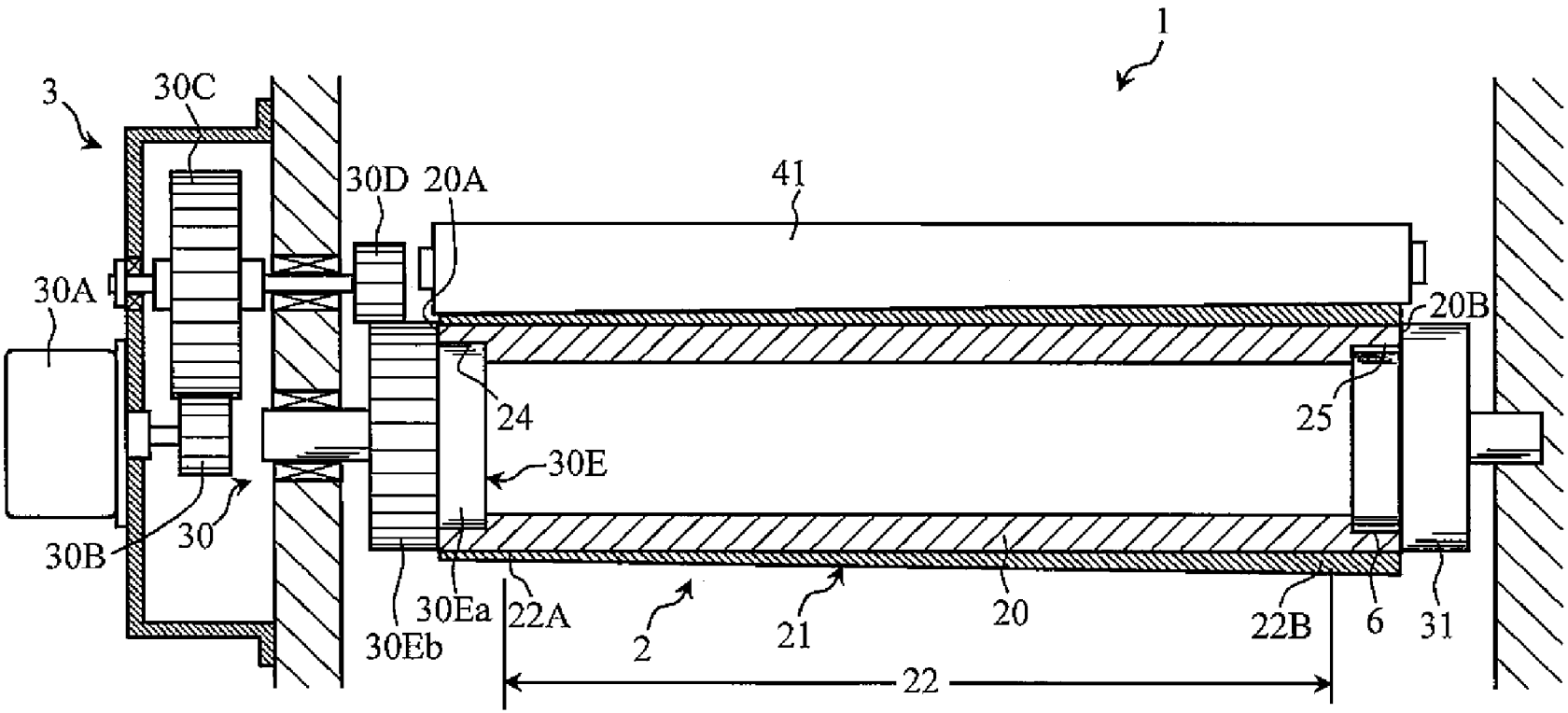
FIG. 9 is a sectional view of the principal portions of the image forming apparatus, illustrating relationship between an electrophotographic photosensitive member and an electrification mechanism.

An electrification roller 41' shown in FIGS. 8 and 9 may be used as the electrification mechanism. The electrification roller 41' is arranged in pressing contact with the electrophotographic photosensitive member 2, and is made by coating a cored bar with conductive rubber and PVDF (polyvinylidene fluoride).

A nip width, which is a circumferential dimension of the body 20 at a contact area between the electrophotographic photosensitive member 2 and the electrification roller 41', gradually becomes smaller as proceeding from the first end portion 22A to the second end portion 22B of the latent image forming area 22, for example. Specifically, slope of a primary approximate line, indicating relationship between a distance from the end 20A of the cylindrical body 20 at the side of the first end portion 22A and a measurement value of nip width, is not less than 0.004 mm/cm and not more than 0.08 mm/cm, for example. Preferably, the absolute value of difference between the value indicated by the primary approximate line and the measurement value of nip width is not more than 0.5 mm.

In using the electrification roller 41', the charging voltage is also selected from not less than 300V and not more than 600V. As described above, in the latent image forming area 22 of the photosensitive layer 21, slope of a primary approximate line, indicating relationship between a distance from the end 20A in the axial direction and a measurement value of dark electric potential in the axial direction when charging the photosensitive layer 21, is not less than 0.4V/cm and not more than 1.5V/cm, for example. The absolute value of difference between the value indicated by the primary approximate line and the measurement value of dark electric potential is not more than 10V.

The exposure mechanism 42 serves to form an electrostatic latent image on the electrophotographic photosensitive member 2, and is capable of emitting light of a predetermined wavelength (not less than 650 nm and not more than 780 nm, for example). The exposure mechanism 42 forms an electrostatic latent image which is an electric potential contrast by emitting light on the surface of the electrophotographic photosensitive member 2 according to an image signal, and lowering the electrical potential at the emitted portion. An example of the exposure mechanism 42 includes a LED head in which LED elements capable of emitting light at a wavelength of e.g. about 680 nm are arranged at 600 dpi.

Of course, the exposure mechanism 42 may be capable of emitting laser light. By replacing the exposure mechanism 42 having LED head with an optical system using e.g. laser light or a polygon mirror or with an optical system using e.g. a lens or a mirror through which light reflected at paper is transmitted, the image forming apparatus may have a function of a copying apparatus.

The development mechanism 43 forms a toner image by developing the electrostatic latent image formed on the electrophotographic photosensitive member 2. The development mechanism 43 includes a magnetic roller 43A for magnetically holding developer (toner) and a wheel (not shown) or a so-called skid for keeping a substantially constant distance (gap) from the electrophotographic photosensitive member 2.

The developer serves to develop a toner image formed on the surface of the electrophotographic photosensitive member 2, and is frictionally charged at the development mechanism 43. The developer may be a binary developer of magnetic carrier and insulating toner, or a one-component developer of magnetic toner.

The magnetic roller 43A serves to transfer the developer to the surface (developing area) of the electrophotographic photosensitive member 2.

In the development mechanism 43, the toner frictionally charged by the magnetic roller 43A is transferred in a form of magnetic brush with bristles each having a predetermined length. On the developing area of the electrophotographic photosensitive member 2, the toner is caused to stick to the surface of the photosensitive member by electrostatic attraction between the toner and the electrostatic latent image, and becomes visible. When the toner image is formed by regular developing, the toner image is charged in the reverse polarity of the polarity of the surface of the electrophotographic photosensitive member 2. On the other hand, when the toner image is formed by reverse developing, the toner image is charged in the same polarity as the polarity of the surface of the electrophotographic photosensitive member 2.

Though the development mechanism 43 utilizes dry developing method, wet developing method using liquid developer may be utilized.

The transfer mechanism 44 transfers the toner image of the electrophotographic photosensitive member 2 on a recording medium P supplied to a transfer area between the electrophotographic photosensitive member 2 and the transfer mechanism 44. The transfer mechanism 44 includes a transfer charger 44A and a separation charger 44B. In the transfer mechanism 44, the rear side (non-recording surface) of the recording medium P is charged in the reverse polarity of the toner image by the transfer charger 44A, and by the electrostatic attraction between this electrification charge and the toner image, the toner image is transferred on the recording medium P. Further, in the transfer mechanism 44, simultaneously with the transfer of the toner image, the rear side of the recording medium P is charged in alternating polarity by the separation charger 44B, so that the recording medium P is quickly separated from the surface of the electrophotographic photosensitive member 2.

As the transfer mechanism 44, a transfer roller driven with the rotation of the electrophotographic photosensitive member 2, and being spaced from the electrophotographic photosensitive member 2 by a minute gap (generally, not more than 0.5 mm) may be used. Such transfer roller applies a transfer voltage to the recording medium P, using e.g. direct-current power source, for attracting the toner image of the electrophotographic photosensitive member 2 onto the recording medium. In using the transfer roller, a separation member such as the separation charger 44B is omitted.

The fixing mechanism 45 serves to fix a toner image, which is transferred on the recording medium P, onto the recording medium P, and includes a pair of fixing rollers 45A, 45B. Each of the fixing rollers 45A, 45B is, for example, a metal roller coated by Teflon (registered trademark). In the fixing mechanism 45, the recording medium P passes through between the fixing rollers 45A, 45B, so that the toner image is fixed on the recording medium P by heat or pressure.

The cleaning mechanism 46 shown in FIGS. 1 and 2 serves to remove the toner remaining on the surface of the electrophotographic photosensitive member 2, and includes a cleaning blade 46A.

The cleaning blade 46A serves to scrape the remaining toner off the surface of the surface layer 29 of the electrophotographic photosensitive member 2. The cleaning blade 46A is supported by a case 46C via urging means such as springs 46B, so that its tip end presses the latent image forming area 22 of the electrophotographic photosensitive member 2. The cleaning blade 46A is made of a rubber material mainly containing polyurethane resin, for example, and has a thickness of not less than 1.0 mm and not more than 1.2 mm at its tip portion in contact with the surface layer 29 (see FIG. 2), a linear pressure of 14 gf/cm (generally not less than 5 gf/cm and not more than 30 gf/cm), and a JIS hardness of 74 degrees (preferably not less than 67 degrees and not more than 84 degrees).

The discharging mechanism 47 removes surface charge on the electrophotographic photosensitive member 2. The discharging mechanism 47 irradiates the whole surface (the surface layer 29) of the electrophotographic photosensitive member 2 by a light source such as LED, and removes the surface charge (remaining electrostatic latent image) of the electrophotographic photosensitive member 2.

In the electrophotographic photosensitive member 2 of the image forming apparatus 1, the power transmitting flange 30E is firmly fixed to the inside low portion 24 at the side of the first end portion 22A, while the bearing flange 31 is attached to the inside low portion 25 at the side of the second end portion 22B with the gap 6.

Thus, when using the non-contact electrification mechanism 41, the distance between the photosensitive layer 21 and the electrification mechanism 41 is larger at the second end portion 22B than at the first end portion 22A. When using the contact electrification mechanism 41, the nip width of the contact area between the photosensitive layer 21 and the electrification mechanism 41 is smaller at the second end portion 22B than at the first end portion 22A.

In the electrophotographic photosensitive member 2, when charging the latent image forming area 22 of the photosensitive layer 21 (the photoconductive layer 28 and the surface layer 29) with a constant charging ability in the axial direction of the cylindrical body 20, dark electric potential at the latent image forming area 22 gradually becomes higher as proceeding from the first end portion 22A to the second end portion 22B in the axial direction of the cylindrical body 20. Therefore, even the distance from the electrification mechanism 41 or the nip width gradually becomes larger or smaller as proceeding from the first end portion 22A to the second end portion 22B, bias in electrostatic adhesion of toner can be prevented, thereby preventing bias in density of an image formed on a recording medium P.

Especially, when forming the photosensitive layer 21 so that slope of a primary approximate line, indicating relationship between a distance from the end 20A of the cylindrical body 20 at the side of the first end portion 22A in the axial direction and a measurement value of dark electric potential in the axial direction when charging the photosensitive layer 21 at a voltage selected from not less than 300V and not more than 600V, is not less than 0.4V/cm and not more than 1.5V/cm, bias in electrostatic adhesion of toner can be properly prevented. When the absolute value of difference between the value indicated by the primary approximate line and the measurement value of dark electric potential is not more than 10V, bias in electrostatic adhesion of toner can also be properly prevented. As a result, in the electrophotographic photosensitive member 2 and the image forming apparatus 1 provided with the photosensitive member, bias in density of an image formed on a recording medium P can be prevented properly.

The present invention is not limited to the above-described embodiments, though may be variously modified. For example, it suffices if, when charging the photosensitive layer 21, dark electric potential becomes gradually higher as proceeding from the first end portion 22A to the second end portion 22B, and if the dark electric potential in at least one of the photoconductive layer 28 and the surface layer 29 becomes gradually higher as proceeding from the first end portion 22A to the second end portion 22B.

Figure 10:
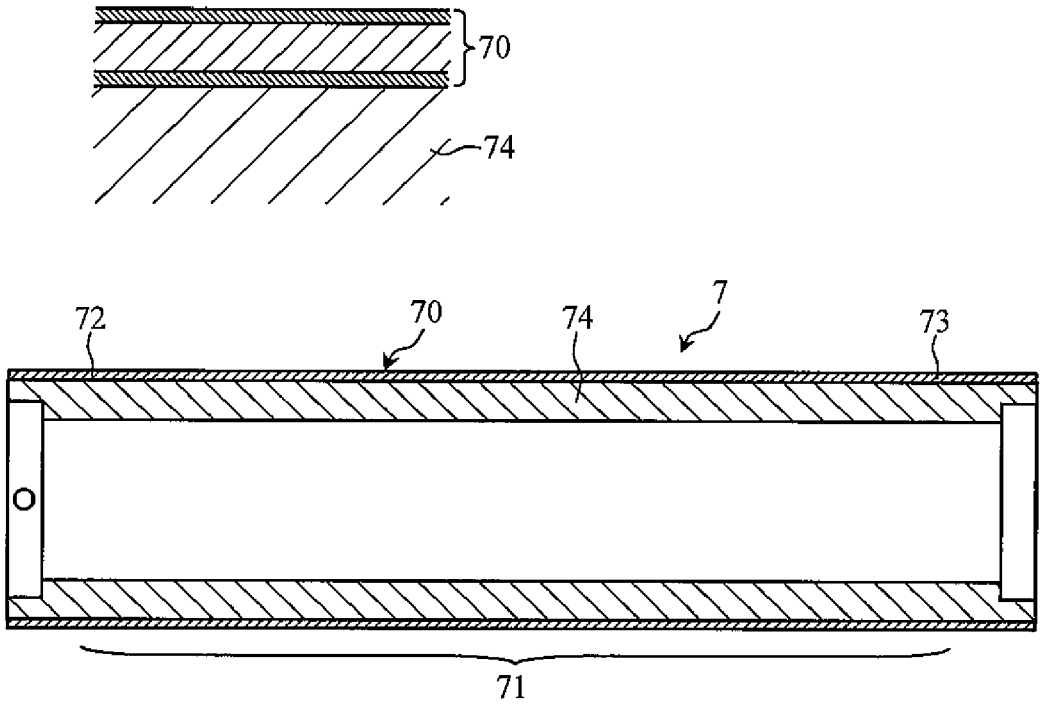
FIG. 10 is a sectional view and an enlarged view thereof illustrating another example of the electrophotographic photosensitive member according to the present invention.

Further, as shown in FIG. 10, an electrophotographic photosensitive member 7 may be provided with a photosensitive layer 70 having a constant thickness at an first end portion 72 and an second end portion 73 of a latent image forming area 71, and dark electric potential may be lower at the first end portion 72 than at the second end portion 73 when charging the cylindrical body 70 with a constant charging ability in the axial direction. Such photosensitive layer 70 can be formed by setting the amount of boron (B) contained at the first end portion 72 to be larger than the amount of boron (B) contained at the second end portion 73. Specifically, in forming the photosensitive layer 70, by setting the temperature at a cylindrical body 74 to be higher at the first end portion 72 than at the second end portion 73, the amount of boron (B) contained at the first end portion 72 can be larger than the amount of boron (B) contained at the second end portion 73 in the photosensitive layer 70. Still further, when forming the photosensitive layer 70 (including a photoconductive layer and a surface layer) using a material mainly containing a-SiC, use may be made of glow discharge decomposition method in which Si-containing gas such as silane gas ($SiH_4$) is used as the material gas, so that the photosensitive layer 70 (including a photoconductive layer and a surface layer) contains boron (B) by an amount of 6 ppm-50 ppm at the first end portion 72, and by an amount of 0 ppm-5 ppm at the second end portion 73 in the axial direction. The amount of boron (B) may be gradually reduced as proceeding from the first end portion 72 to the second end portion 73 by 0 ppm-50 ppm.

EXAMPLE

In the present example, it was studied how changes in dark electric potential in the axial direction affects influence on variation in image was studied by when charging various types of electrophotographic photosensitive members and examining are charged changes in dark electric potential in the axial direction.

(Manufacture of Electrophotographic Photosensitive Member)

In manufacturing the electrophotographic photosensitive member, an aluminum drawn tube (cylindrical body) with dimensions indicated in the following Table 1 was prepared, on which a photosensitive layer (including an anti-charge injection layer, a photoconductive layer, and a surface layer) was formed under conditions indicated in the following Table 2.

Note that mirror finishing was performed on the outer circumference of the cylindrical body before cleaning.

In forming the photoconductive layer and the surface layer of the photosensitive layer, the glow discharge decomposition device 5 shown in FIGS. 4 and 5 as well as the gas inlet tube 55 shown in FIG. 6 were utilized. A plurality of gas inlet tubes with differently arranged gas inlet ports 56 were used to manufacture six types of electrophotographic photosensitive members 1-6.

TABLE 1

| Dimension of Cylindrical Body | |
|---|---|
| Outer Diameter (mm) | 84 |
| Inner Diameter (mm) | 78 |
| Length (mm) | 380 |
| Inner Diameter of Inside Low Portion (mm) | 80 |
| Depth of Inside Low Portion (mm) | 15 |

TABLE 2

| Forming Conditions of Electrophotographic Photosensitive Member | | | |
|---|---|---|---|
| | Anti-charge Injection Layer | Photoconductive Layer | Surface Layer |
| Temperature of Body Supporter [° C.] | 260 | 260 | 260 |
| Gas Pressure [Pa] | 60 | 77 | 73 |
| 13.56 Hz RF Electric Power [W] | 110 | 125 | 155 |
| Film Forming Time [min] | 95 | 550 | 80 |
| $SiH_4$ Gas Flow Amount [sccm] | 75 | 100 | 40 |
| $CH_4$ Gas Flow Amount [sccm] | — | — | 230 |
| $B_2H_6$ Gas Flow Amount [sccm] | 0.1 | 0.0002 | — |
| NO Gas Flow Amount [sccm] | 10 | — | — |
| He Gas Flow Amount [sccm] | — | — | — |
| $H_2$ Gas Flow Amount [sccm] | — | 125 | 295 |

(Calculating Rate of Change of Dark Electric Potential Change)

The dark electric potential of the photosensitive layer was obtained by charging the photosensitive layer of the electrophotographic photosensitive member incorporated in an image forming apparatus (Model: "IRC5800" manufactured by Canon Inc.), and then measuring the surface of the photosensitive layer using a non-contact surface potential measuring devicevoltmeter ("MODEL 344" manufactured by TREK, Inc.). The voltage for charging the electrophotographic photosensitive member was set to 500V. The dark electric potential of the electrophotographic photosensitive member was measured at four points spaced from the end of the cylindrical body (indicated by the reference character "20A" in FIG. 3) by 5 cm (point 1), 15 cm (point 2), 25 cm (point 3), and 35 cm (point 4).

Figure 11:
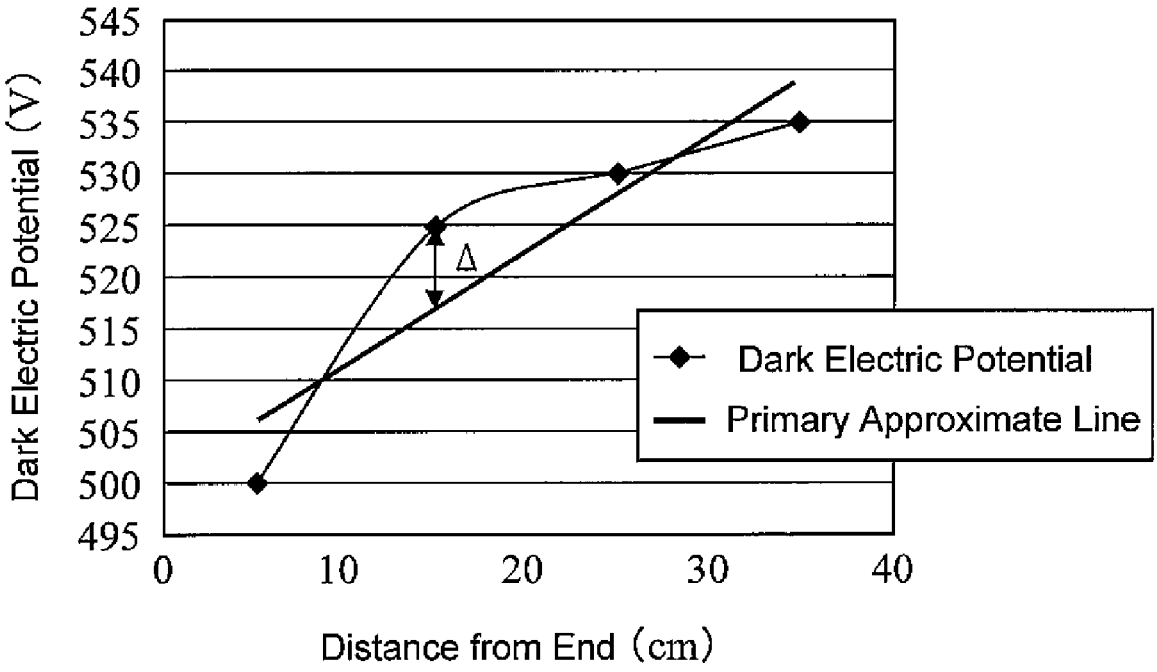
FIG. 11 is a graph indicating a measurement result of dark electric potential and a primary approximate line of an example.
Figure 12:
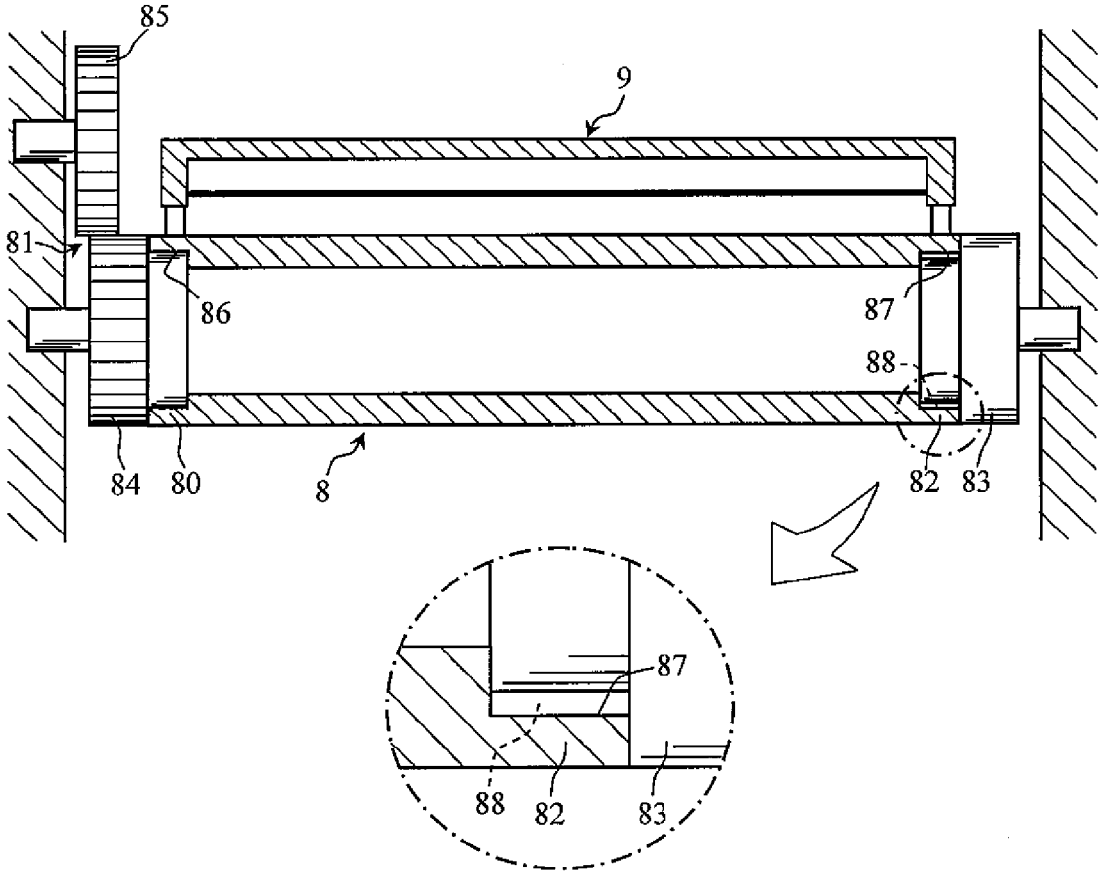
FIG.12 PRIOR ART
FIG. 12 is a sectional view corresponding to FIG. 2, illustrating an image forming apparatus provided with a conventional electrophotographic photosensitive member.

The rate of change of dark electric potential was calculated by obtaining a primary approximate line by least-square method to indicate the relationship between the distance from the end (indicated by the reference character "20A" in FIG. 3) and a value of dark electric potential measured at each of the above four points. The obtained data of primary approximate lines and measurement values of the dark electric potential are indicated in the following Table 3. In Table 3, slope of each of the primary approximate lines and differences Δ between values provided by the primary approximate line and actual measurement values are also indicated. Further, as an example, FIG. 11 illustrates a graph indicating actual measurement values and primary approximate line of electrophotographic photosensitive member No. 3.

(Evaluation of Variation in Image)

The electrophotographic photosensitive members were incorporated in an image forming apparatus (Model: "IRC5800" manufactured by Canon Inc.) for printing 300 thousand copies using A4 office paper, and variation in image was evaluated by visual check. The results of visual check were respectively indicated as "o" when no variation in image was found, as "Δ" when a slight variation in image was found, and as "x" when an obvious variation in image was found. The evaluation results are also shown in Table 3.

TABLE 3

| No. | Distance from End | Dark Electric Potential | Slope of Primary Approximate Line | Difference Δ between Value of Primary Approximate Line and Actual Measurement Value | Evaluatio of Variatio in Image |
|---|---|---|---|---|---|
| 1 | 5 cm | 470 V | 1.8 | −3 | Δ |
| | 15 cm | 495 V | | 4 | |
| | 25 cm | 510 V | | 1 | |
| | 35 cm | 525 V | | −2 | |
| 2 | 5 cm | 480 V | 1.4 | −1.5 | ○ |
| | 15 cm | 495 V | | −0.5 | |
| | 25 cm | 515 V | | 5.5 | |
| | 35 cm | 520 V | | −3.5 | |
| 3 | 5 cm | 500 V | 1.1 | −6 | ○ |
| | 15 cm | 525 V | | 8 | |
| | 25 cm | 530 V | | 2 | |
| | 35 cm | 535 V | | −4 | |
| 4 | 5 cm | 498 V | 1.0 | −0.5 | x |
| | 15 cm | 501 V | | −7.5 | |
| | 25 cm | 535 V | | 16.5 | |
| | 35 cm | 520 V | | −8.5 | |
| 5 | 5 cm | 495 V | 0.43 | −0.8 | ○ |
| | 15 cm | 501 V | | 0.9 | |
| | 25 cm | 505 V | | 0.6 | |
| | 35 cm | 508 V | | −0.7 | |
| 6 | 5 cm | 500 V | 0.05 | 0 | x |
| | 15 cm | 501 V | | 0.5 | |
| | 25 cm | 500 V | | −1 | |
| | 35 cm | 502 V | | 0.5 | |

As seen from Table 3, no variation in image was found in the electrophotographic photosensitive members No. 2, No. 3, and No. 5 in which slopes of the primary approximate lines are respectively 1.4V/cm, 1.1V/cm, and 0.43V/cm.

In the electrophotographic photosensitive members No. 2, No. 3, and No. 5, slopes of the primary approximate lines lie in a range of 0.43V/cm-1.4V/cm.

On the other hand, a slight variation in image was found in the electrophotographic photosensitive member No. 1 in which slope of the primary approximate line is 1.8V/cm, while obvious variation in image was found in the electrophotographic photosensitive members No. 4 and No. 6 in which slopes of the primary approximate line were respectively 1.0V/cm and 0.05V/cm.

Here, in the electrophotographic photosensitive member No. 4, slope of the primary approximate line is 1.0V/cm, which lies within the range (0.43V/cm-1.4V/cm) defined by the slopes of the primary approximate lines of the electrophotographic photosensitive members No. 2, No. 3, and No. 5 where no variation in image was found. However, in the electrophotographic photosensitive member 4, the dark electric potential at the point spaced from the end of the cylindrical body (indicated by the reference character "20A" of FIG. 3) by 35 cm (point 4) is lower than at the point spaced therefrom by 25 cm (point 3) and the dark electric potential does not become gradually larger as proceeding from the first end portion to the second end portion of the latent image forming area.

Further, in the electrophotographic photosensitive members No. 2, No. 3, and No. 5, the absolute value of difference Δ between the value indicated by the primary approximate line and the actual measurement value was 8V at most, whereas the difference Δ in the electrophotographic photosensitive member 4 was 16.5V at most.

In view of the above-described results, in the electrophotographic photosensitive member, variation in image can be prevented when the dark electric potential gradually becomes larger as proceeding from the first end portion to the second end portion of the latent image forming area, and it is preferable that slope of the primary approximate line is not less than 0.4V/cm and not more than 1.5V/cm. It is more preferable that the absolute value of difference Δ between the value indicated by the primary approximate line and the actual measurement value is not more than 10V.

The invention claimed is:

1. An electrophotographic photosensitive member comprising:

a cylindrical body to be rotated by rotation power transmitted via an first end portion in an image forming apparatus; and a photosensitive layer formed on the cylindrical body;

wherein when charging the body with a constant charging ability in an axial direction of the cylindrical body, dark electric potential at a latent image forming area gradually becomes larger from the first end portion to a second end portion opposite to the first end portion.

2. The electrophotographic photosensitive member according to claim 1, wherein the photosensitive layer includes a photoconductive layer, wherein when charging with the constant charging ability in the axial direction, dark electric potential at the latent image forming area in the photoconductive layer gradually becomes larger from the first end portion to the second end portion.

3. The electrophotographic photosensitive member according to claim 1, wherein the photosensitive layer includes a photoconductive layer and a surface layer, wherein when charging with the constant charging ability in the axial direction, dark electric potential at the latent image forming area in the surface layer gradually becomes larger from the first end portion to the second end portion.

4. The electrophotographic photosensitive member according to claim 1, wherein a primary approximate line indicates a relationship between a distance from an end at the first end portion in the axial direction and a measurement value of dark electric potential in the axial direction when charging the photosensitive layer with a constant voltage selected from not less than 300V and not more than 600V, slope of the primary approximate line being not less than 0.4V/cm and not more than 1.5V/cm.

5. The electrophotographic photosensitive member according to claim 4, wherein the primary approximate line indicates the relationship between the distance from the end at the first end portion in the axial direction and the measurement value of dark electric potential in the axial direction, when charging the photosensitive layer with the constant voltage selected from not less than 300V and not more than 600V, and absolute value of difference between a value obtained by the primary approximate line and the measurement value is not more than 10V.

6. The electrophotographic photosensitive member according to claim 1, wherein the photosensitive layer contains an inorganic material including a silicon.

7. An image forming apparatus comprising:

an electrophotographic photosensitive member including a cylindrical body, and a photosensitive layer formed on the cylindrical body;

a power transmitter for transmitting rotation power to a first end portion of the electrophotographic photosensitive member in an axial direction of the electophotographic photosensitive member; and an electrification mechanism for charging with a constant charging ability in the axial direction;

wherein when charging with a constant charging ability in the axial direction, dark electric potential at a latent image forming area in the photosensitive layer gradually becomes larger from the first end portion to a second end portion opposite to the first end portion.

8. The image forming apparatus according to claim 7, wherein the photosensitive layer includes a photoconductive layer, wherein when charging with a constant charging ability in the axial direction, dark electric potential at the latent image forming area in the photoconductive layer gradually becomes larger from the first end portion to the second end portion.

9. The image forming apparatus according to claim 7, wherein the photosensitive layer includes a photoconductive layer and a surface layer, wherein when charging with a constant charging ability in the axial direction, dark electric potential at the latent image forming area in the surface layer gradually becomes larger from the first end portion to the second end portion.

10. The image forming apparatus according to claim 7, wherein a primary approximate line indicates a relationship between a distance from an end at the first end portion in the axial direction and a measurement value of dark electric potential in the axial direction when charging the photosensitive layer with a constant voltage selected from not less than 300V and not more than 600V, slope of the primary approximate line being not less than 0.4V/cm and not more than 1.5V/cm.

11. The image forming apparatus according to claim 10, wherein absolute value of difference between a value obtained by the primary approximate line and the measurement value is not more than 10V.

12. The image forming apparatus according to claim 7, wherein the photosensitive layer contains an inorganic material including a silicon.

13. The image forming apparatus according to claim 7, wherein the electrification mechanism is a non-contact electrification mechanism, a distance from the photosensitive layer in the latent image forming area to the electrification mechanism gradually becoming larger from the first end portion to the second end portion in the axial direction.

14. The image forming apparatus according to claim 13, wherein a primary approximate line indicates a relationship between a distance from an end at the first end portion in the axial direction and a measurement value of a distance from the photosensitive layer in the latent image forming area to the non-contact electrification mechanism, slope of the primary approximate line being not less than 10 μm/cm and not more than 100 μm/cm.

15. The image forming apparatus according to claim 14, wherein the primary approximate line indicates the relationship between the distance from the end at the first end portion in the axial direction and the measurement value of the distance from the photosensitive layer in the latent image forming area to the non-contact electrification mechanism, and absolute value of difference between a value obtained by the primary approximate line and the measurement value is not more than 700 μm.

16. The image forming apparatus according to claim 7, wherein the electrification mechanism is a contact electrification mechanism, wherein a nip width between the photosensitive layer in the latent image forming area and the contacting electrification mechanism, gradually becomes smaller from the first end portion to the second end portion in the axial direction.

17. The image forming apparatus according to claim 16, wherein a primary approximate line indicates a relationship between a distance from an end at the first end portion in the axial direction and a measurement value of the nip width, slope of the primary approximate line being not less than 0.004 mm/cm and not more than 0.08 mm/cm.

18. The image forming apparatus according to claim 17, wherein the primary approximate line indicates the relationship between the distance from the end at the first end portion in the axial direction and the measurement value of the nip width, and absolute value of difference between a value obtained by the primary approximate line and the measurement value is not more than 0.5 mm.

* * * * *